United States Patent [19]

Haas et al.

[11] 4,087,507

[45] May 2, 1978

[54] PROCESS FOR IMPROVING THE PRODUCTION EFFICIENCY OF WOVEN POLYPROPYLENE FABRICS

[75] Inventors: Peter Haas; Klaus Koblischke, both of Gronau, Germany

[73] Assignee: Standard Oil Company (Indiana), Chicago, Ill.

[21] Appl. No.: 642,680

[22] Filed: Dec. 19, 1975

[51] Int. Cl.[2] ..... D01F 1/02

[52] U.S. Cl. ..... 264/211; 260/32.6 PQ; 260/42.45; 260/897 A

[58] Field of Search ..... 264/211; 260/42.45, 260/42.46, 45.9 NC, 561 K, 32.6 PQ, 897 A

[56] References Cited

U.S. PATENT DOCUMENTS

| | | | |
|---|---|---|---|
| 2,462,358 | 2/1949 | Caldwell | 260/561 K |
| 2,956,035 | 10/1960 | Mock | 260/42.46 |
| 2,991,264 | 7/1961 | Monroe et al. | 260/42.46 |
| 3,028,355 | 4/1962 | Toy et al. | 260/42.46 |
| 3,322,607 | 5/1967 | Jung | 161/67 |
| 3,355,416 | 11/1967 | Stevenson | 260/42.46 |
| 3,399,156 | 8/1968 | Bell | 260/29.1 |
| 3,503,922 | 3/1970 | Carton | 260/42.46 |
| 3,876,608 | 4/1975 | Anderson et al. | 260/42.46 |
| 3,969,304 | 7/1976 | Pugh et al. | 260/42.46 |
| 3,985,933 | 10/1976 | Mehta et al. | 260/147 |

FOREIGN PATENT DOCUMENTS

| | | | |
|---|---|---|---|
| 47-13852 | 4/1972 | Japan | 260/42.46 |

*Primary Examiner*—Jay H. Woo

*Attorney, Agent, or Firm*—Gregory E. Croft; Arthur G. Gilkes; William T. McClain

[57] ABSTRACT

Efficiency in the production of woven polypropylene fabrics is greatly improved through the use of an additive comprising fine silica particles. Addition of the abovesaid additive to the resin prior to extrusion of the ribbon yarns increases weaving efficiency, reduces burling time, decreases the frequency of weaving faults such as lost or broken picks, and permits the use of larger weft yarn packages.

2 Claims, No Drawings

PROCESS FOR IMPROVING THE PRODUCTION EFFICIENCY OF WOVEN POLYPROPYLENE FABRICS

BACKGROUND OF THE INVENTION

1. Field of the Invention

This invention relates to an improved process for the production of woven polypropylene fabrics. More specificlaly, it relates to improved efficiency in the production of polypropylene carpet backing.

2. Description of the Prior Art

The additive used in the preferred embodiment of this invention is marketed by Badische-Aniline-Soda-Fabrik (BASF) under the trade name of Lufilen E 100. The Lufilen additive is primarily sold as a delustering agent for use in polyester spinning processes to deluster the product. It has been found that although this additive performs its intended purpose as a delustering agent very poorly in the production of polypropylene tapes which are subsequently woven into carpet backing, this additive unexpectedly has a remarkable effect on the efficiency of downstream operations such as weaving and burling. Accordingly, it is an object of this invention to provide better efficiency in a process for the production of woven polypropylene fabrics.

This and other objects will be readily apparent upon reading the specification.

SUMMARY OF THE INVENTION

Broadly, the invention resides in an improved process for producing polypropylene fabrics wherein polypropylene resin is extruded into flat ribbon yarns which are subsequently woven into fabrics, the improvement comprising the addition of 0.5 to 5 weight percent of an additive to the resin prior to extrusion, said additive containing fine silica particles, whereby greatly improved production efficiency is achieved with relatively little effect on the luster of the ribbon yarns. It has unexpectedly been discovered that the use of such an additive increases weaving efficiency, reduces burling time, decreases the frequency of weaving faults such as lost picks and broken picks, and allows the use of larger weft yarn packages. Although the silica particles are believed to be the active ingredient, it is preferable that the additive contain a large amount of low density polyethylene.

More specifically, the amount of low density polyethylene in the additive can range from 70 to 90 weight percent.

Still more specifically, the amount of silica particles in the additive can range from 10 to 30 weight percent.

Still more specifically, the silica particles can substantially range in size from 0.5 to 30 microns.

In a further aspect, the invention resides in an improved process for producing polypropylene fabrics wherein polypropylene resin is extruded into flat ribbon yarns which are subsequently woven into fabrics, the improvement comprising the addition of 0.5 to 5 weight percent of an additive to the resin prior to extrusion, said additive containing low density polyethylene, fine silica particles, and a stabilizer, such as N-n-hexadecylacetoacetamide, whereby greatly improved production efficiency is achieved with relatively little effect on the luster of the ribbon yarns.

Specifically, the amount of low density polyethylene in the additive can range from 70 to 90 weight percent. The amount of N-n-hexadecylacetoacetamide in the additive can range from 0.5 to 5 weight percent. And the amount of silica particles in the additive can range from 10 to 30 weight percent.

More specifically, the silica particles can substantially range in size from 0.5 to 30 microns.

In a preferred aspect, the invention resides in an improved process for producing polypropylene fabrics wherein polypropylene resin is extruded into flat ribbon yarns which are subsequently woven into fabrics, the improvement comprising the addition of about 1 weight percent of an additive to the resin prior to extrusion, said additive containing about 79 weight percent polyethylene having a density of about 0.92 grams per cubic centimeter, about 20 weight percent silica particles substantially having a size range from 1 to 20 microns, and about 1 weight percent N-n-hexadecylacetoacetamide, whereby greatly improved production efficiency is achieved with relatively little effect on the luster of the ribbon yarns.

DESCRIPTION OF THE PREFERRED EMBODIMENT

In the production of polypropylene carpet backing, polypropylene resin is extruded into thin sheets or webs which are continuously slit into ribbons as the web leaves the extruder. These ribbons are passed through an oven and simultaneously stretched to provide proper orientation and thickness. The ribbons are then ready for subsequent weaving operations.

During weaving, the warp yarns, which run in the machine direction, are fed to the loom from a large cylinder called the loom beam. Each loom beam feeds from 100 to several thousand ends, depending upon the width of the loom and the desired closeness of the weave. The weft or fill yarns, which run in the cross-machine direction, are fed to the loom from small packages located beside the loom. In the Sulzer loom, the end of each fill yarn package is automatically grasped by a small shuttle which is mechanically propelled through the shed to the other side of the loom. The fill yarn is then cut and the shuttle returns to repeat the process. Each pass of the shuttle is termed a "pick". Occasionally the shuttle may break the fill yarn while passing through the shed. This is called a "broken pick". Also, the shuttle may fail to grasp the end of the fill yarn from the package and travel through the shed without any fill yarn at all. This is termed a "lost pick".

After the weaving operation, the woven fabric is subjected to burling and mending to cure defects. The burling consists of removing knots and loose threads, whereas the mending eliminates holes, missed warp yarns and filling picks, as well as other defects.

It has unexpectedly been found that the addition of 1 weight percent Lufilen E 100, sold by BASF as a delustering agent, results in improved efficiency of the downstream process. An analysis of the Lufilen showed that it contains about 79 weight percent polyethylene, said polyethylene having a density of 0.92 grams per cubic centimeter. It also contains about 20 weight percent very fine silica particles, predominately ranging in size from about 1 to 20 microns, and also about 1 weight percent N-n-hexadecylacetoacetamide. It is believed that the amide is present as an antioxidant for the polyethylene and is not responsible for the improved process efficiency which results from the use of Lufilen. Accordingly it is believed that the benefits of this invention may be achieved by use of an additive containing only low density polyethylene and fine silica particles, and the scope of this invention should not be limited to the scope of the preferred embodiment, which is set forth only as an illustration.

The results of the addition of 1 weight percent Lufilen to the fill yarn resin, producing a fill yarn having a 1050 denier, are set forth in the Table below. The Lufilen was added only to the fill yarns because the fill yarns have a greater influence on weaving efficiency than do the warp yarns.

TABLE

| | Without Lufilen | With Lufilen | Change (Percent) |
|---|---|---|---|
| Lost Picks from 10,000 Square Meters | 35.0 | 26.0 | −25.7 |
| Broken Picks from 10,000 Square Meters | 676 | 107 | −84.2 |
| Burling Time in Minutes for 10,000 Square Meters | 399 | 257 | −35.6 |
| Weaver Efficiency[1] (Percent) | 92.9 | 95.9 | +3.0 |
| Total Weave Room Efficiency[2] (Percent) | 83.3 | 91.2 | +7.9 |

[1]"Weave Efficiency" is the percentage of loom capacity each weaver is utilizing.
[2]"Total Weave Room Efficiency" is the percentage of full capacity at which the entire weave room is operating.

The use of the Lufilen additive produced ribbon yarns which were smoother, softer, and showed less fibrillation. As is readily seen from the table, the improvements resulting in the downstream operations are remarkable and totally unexpected. The number of lost picks decreased more than 25%, the number of broken picks decreased more than 84%, the amount of burling time decreased more than 35%, the individual weaver efficiency increased 3%, and the total weave room efficiency increased almost 8%. Because of this increased efficiency and decreased loom stoppage, the number of looms per weaver has been increased from 10 to 12.

The amount of the additive which can be used will of course vary with the economics of the specific process in which it is used. A reasonable range would be from 0.5 to 5 weight percent, with 1 weight percent being preferred.

Accordingly, it will be obvious to those skilled in the art that many variations may be made from the preferred embodiment without departing from the scope of this invention.

We claim:

1. In a process for producing polypropylene fabrics, wherein polypropylene resin is extruded into flat ribbon yarns which are subsequently woven into fabrics, the improvement comprising the addition of about 1 weight percent of an additive to the resin prior to extrusion, said additive containing about 79 weight percent polyethylene having a density of about 0.92 grams per cubic centimeter, about 20 weight percent silica particles substantially having a size range from 1 to 20 microns, and about 1 weight percent N-n-hexadecylacetoacetamide, whereby greatly improved production efficiency is achieved with relatively little effect on the luster of the ribbon yarns.

2. In a process for producing polypropylene fabrics wherein polypropylene resin is extruded into flat ribbon yarns which are subsequently woven into fabrics, the improvement comprising the addition of 0.5 to 5 weight percent of an additive containing from 70 to 90 weight percent low density polyethylene, from 10 to 30 weight percent silica particles, and from 0.5 to 5 weight percent N-n-hexadecylacetoacetamide, whereby greatly improved production efficiency is achieved with relatively little effect on the luster of the ribbon yarns.

* * * * *